United States Patent [19]

King

[11] 4,040,147

[45] Aug. 9, 1977

[54] SHOULDER STRAP RETAINER

[76] Inventor: Marguerite King, Trevecca Towers 11 Apt. 1431, 84 Lester Ave., Nashville, Tenn. 37210

[21] Appl. No.: 706,176

[22] Filed: July 19, 1976

[51] Int. Cl.[2] ..... A44B 9/00

[52] U.S. Cl. ..... 24/86 A; 24/73 SA

[58] Field of Search ..... 24/86, 73 SA, 73 LF, 24/73.1; 2/2; 224/26 K

[56] References Cited

U.S. PATENT DOCUMENTS

| | | | |
|---|---|---|---|
| 1,597,056 | 8/1926 | Cloud | 24/73 LF |
| 2,528,854 | 11/1950 | Burk et al. | 24/73.1 |

FOREIGN PATENT DOCUMENTS

| | | | |
|---|---|---|---|
| 15,901 | 9/1908 | United Kingdom | 24/73.1 |

*Primary Examiner*—Werner H. Schroeder
*Assistant Examiner*—Doris L. Troutman

[57] ABSTRACT

A shoulder strap retainer having a base to be positioned on the exterior shoulder portion of a garment with securing means attached to the undersurface of the base for removably securing the base to the exterior shoulder portion of the garment. A flexible cover is provided in a common overlapping plane for defining a pocket to contain the shoulder strap with locking means for retaining the flexible cover releasably secured to the base to retain the strap in the pocket. Releasing means is provided for disengagement of a catch associated with the locking means so that the strap is positionable into or out of the pocket.

5 Claims, 6 Drawing Figures

SHOULDER STRAP RETAINER

BACKGROUND OF THE INVENTION

The present invention generally relates to a shoulder strap retainer and more particularly to a unique construction for retaining shoulder straps in place.

Although a number of shoulder straps or retainers for use with garments have been proposed, it is the purpose of the present invention to provide an all purpose shoulder bag caddy what would firmly keep the bag in place preventing loss or theft and at the same time permitting easy securement to the garment and permitting the opening and closing thereof only upon proper contact of the retainer. In this manner accidental opening of the retainer with possible loss of the pocketbook which may contain valuables associated therewith is prevented.

OBJECTS OF THE INVENTION

An object of the invention is to provide a retainer adapted to be releasably secured to a garment for receiving therein a strap of a bag or other wearing apparel.

Another object of the invention is to provide a retainer to be conveniently secured to the garment and permitting the retainer to remain in a locked position until manually released by the user.

Another object of the invention is to provide a retainer which may be decorated with attractive colors to match the particular garment being worn.

Other objects and advantages of the present invention will become apparent as the disclosure proceeds.

SUMMARY OF THE INVENTION

A shoulder strap retainer that includes a base having a fixed end and free end adapted to be positioned on the exterior shoulder portion of a garment. Securing means is attached to the undersurface of the base for removably securing the base to the exterior shoulder portion of the garment. A flexible cover having a free end and a fixed end is attached to the fixed end of the base for movement between open and closed positions and extending in a common overlapping plane for defining a pocket to contain the shoulder strap.

Locking means for retaining the flexible cover releasably secured to the free end of the base to retain the strap in the pocket is provided and is integrally formed with the flexible cover. A downwardly projecting arm terminating in an inwardly projecting catch designed to slightly overhang the free end of the base to retain the flexible cover in the closed position of the retainer is provided as the locking means. Releasing means for disengagement of the catch from the free end of the base is provided so that the strap is positionable into or out of the pocket. The releasing means includes fulcrum means laterally displaced from the free end of the base and vertically extending above the base by a distance such that a manually applied downwardly extending force against the cover between the fixed end and the fulcrum means causes a deflection of the cover therebetween and an angular outward displacement of the catch for disengagement with the free end of the base so that release thereof is obtained.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
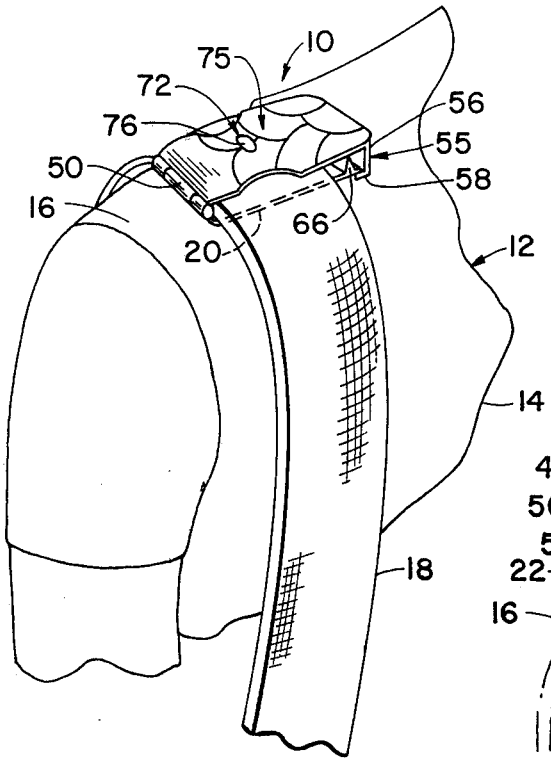
FIG. 1 is a perspective view of a portion of a garment with the retainer of the present invention secured thereto.

FIGS. 1–6 illustrate a shoulder strap retainer 10 that is adapted to be used by a person 12 having a garment 14 that includes an exterior shoulder portion 16. The shoulder strap retainer 10 is adapted to retain in place a shoulder bag strap 18 that may vary in width or thickness and still permit the operation of the retainer 10 as hereinafter discussed in detail. The retainer 10 in effect forms or acts as a shoulder bag caddy that may be secured to a garment 14 that may be a dress, sweater, coat, etc., normally worn.

The retainer 10 includes an elongated base 20 having a fixed end 22 and a free end 24 in spaced apart relation to each other. The base 20 further includes an undersurface 26 and a top surface 28 in spaced relation to each other. The base 20 may be made of a plastic or metallic material. In order to attach the retainer 10 to the garment 14 at the shoulder portion 16 securing means 30 is provided which is attached to the undersurface 26 of the base 20 for removably securing the base 20 to the exterior shoulder portion 16 of the garment 14. The securing means 30 includes a pin 3 pivotally mounted at one end 34 with the other end 36 having a point for piercing the shoulder portion 16 and for being positioned within a latch 38 mounted on the undersurface 26. In this manner, the user of the retainer 10 can secure, at any particular location, the retainer 10 to the garment 14. When it is desired to remove the retainer 10 from the position as seen in FIG. 1, the pin 32 is released from the latch 38 and the complete retainer 10 can be removed for future use.

Figure 2:
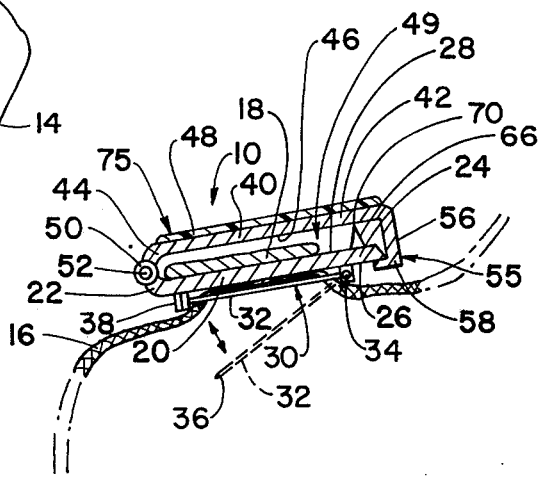
FIG. 2 is a sectional view illustrating the retainer in its closed position secured to the garment.

A flexible cover 40 is provided having a free end 42 and a fixed end 44 in spaced relation to each other. The cover 40 includes a bottom surface 46 and an upper surface 48. The space between the upper surface 28 and the bottom surface 46 defines the pocket 49 into which the strap 18 is placed as seen in FIG. 2. The cover 40 is adapted for movement between open and closed positions with the cover 40 extending in a common overlapping plane with the base 20.

The cover 40 and base 20 may be integrally formed at their respective fixed ends 44 and 22 or as illustrated a hinge 50 is provided that extends transversely across the width of the base 20 and cover 40 having a hinge pin 52 for securing the portion of the hinge 50 together. This provides the means for pivotally securing the respective fixed ends 22 and 44 together and permitting relative movement of the free ends 24 and 42 away from and towards each other such that the cover 40 may be opened into nonoverlapping relation with the base 20 to permit the strap 18 to be placed in position on the upper surface 28 of the base 20 and contained within the pocket 49. The cover 40 which has to be flexible may be made out of plastic or metallic material.

Figure 3:
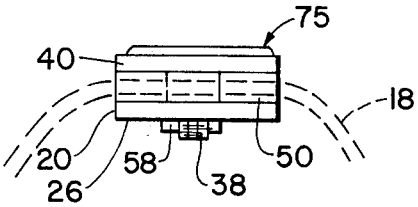
FIG. 3 is an end view looking in the direction of the fixed ends of the retainer.

Locking means 55 is provided for retaining the flexible cover 40 releasably secured with the free end 24 of the base 20 to retain the strap 18 within the pocket 49. The locking means 55 includes a downwardly projecting arm 56 that may be integrally formed with the cover 40 and terminating in an integrally formed inwardly projecting catch 58 having an inner edge 60 and terminal end 62 an seen in FIG. 4. The inwardly projecting catch 58 is designed to slightly overhang the free end 24 of the base 20 to retain the flexible cover 40 in the closed position of the retainer as seen in FIG. 2. The inner edge 60 abuts the undersurface 26 of the base 20. The free end 24 of the base 20 has an inclined outwardly extending surface 64 to facilitate the movement of the terminal end 62 of the catch 58 moving across the free end 24 of the base 20 and snapping into the position as seen in FIG. 2. In this manner, the catch 58 grips the free end 24 of the base 20 until same is released. As seen in FIG. 3, the catch 58 is narrower than the width of the base 20.

Figure 4:
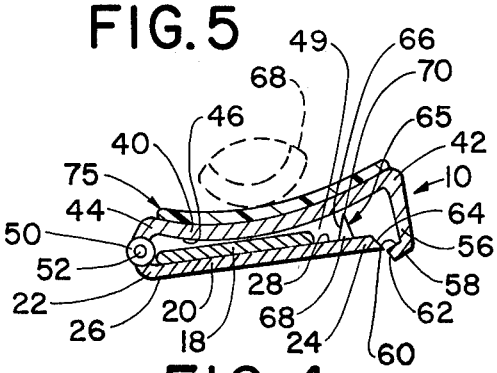
FIG. 4 is a view similar to FIG. 2 illustrating the operation of releasing the cover of the retainer.

Releasing means 65 is provided for disengagement of the catch 58 from the position illustrated in FIG. 2. To accomplish this the releasing means 65 includes fulcrum means 66 displaced from the free end 24 of the base 20 and vertically extending above the inner surface 28 of the base 20 by a distance that is selected such that a manually applied downwardly extending force as by finger 68 against the cover 40 between the fixed end 44 and the fulcrum means 66 causes a deflection of the cover 40 as seen in FIG. 4. The magnitude of the deflection is limited by the bottom surface 46 engaging the strap 18, but this magnitude is sufficient to obtain an angular outward displacement of the arm 56 and catch 58 for disengagement with the free end 24 of the base 20 so that release thereof is obtained. Once the release is obtained then the cover 40 may be swung open since it pivots around the hinge 50 to facilitate the removal of the strap 18 from within the pocket 49. The fulcrum means 66 has a base 68 that may be secured to or integrally formed with the base 20 and having an upper edge or tip 70 with the tip 70 being narrower than the base 68. The width of the base 68 may be substantially equal to the width of the catch 58 an in alignment therewith.

Figure 5:
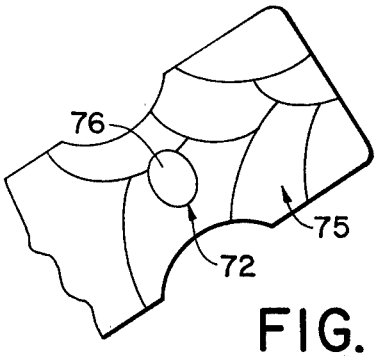
FIG. 5 is a partial top plan view of the retainer illustrated in FIG. 1.
Figure 6:
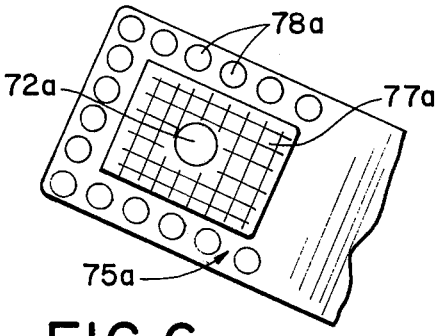
FIG. 6 is an alternate embodiment illustrating a variation in the design of the top of the cover.

To further assist the user in operation of the retainer 10, guide means 72 has been provided which is illustrated in FIGS. 1, 5 and 6 for assisting the positioning of the finger 68 of the user on the cover 40 in order to obtain the position thereof which best releases the catch 62. As seen the cover 40 has on the upper surface 48 thereof decorative means 75 which may take various shapes and configurations and may be formed as part of the cover 40 or secured thereto as by an adhesive. The guide means 72 may take the form of a finger depression 76 which forms a seat for the bottom of the finger. If desired the guide means may be a marking on the decorative means 75 such that it is clearly visible to the user and may even be formed by an inlay on the decorative means 75.

FIG. 6 illustrates a variation in that the decorative means 75*a* that may include a central portion 77*a* having the guide means 72*a* centrally disposed thereon with peripheral inlay design 78*a* extending around a portion of the central portion 77*a.* It is obvious that a great variety of surface configurations may be provided to produce various designs depending upon the type of garment the retainer is to be worn with.

Accordingly, the retainer of the present invention as described above is adapted to be removably secured to a variety of garments and by utilization of the releasing means with minimal force the locking means is deactivated and the cover may be swung open to gain easy access for both removing and placing the strap in position therein.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. A shoulder strap retainer comprises:

a. a base having a fixed end and free end adapted to be positioned on the exterior shoulder portion of a garment;

b. securing means attached to the undersurface of said base for removably securing said base to the exterior shoulder portion of the garment, said securing means includes a pin pivotally mounted at one end thereof, with the other end having a point for piercing the garment and releasably held in place relative to said base;

c. a flexible cover having a free end and a fixed end attached to said fixed end of said base for movement between open and closed positions and extending in a common overlapping plane for defining a pocket to contain the shoulder strap;

d. locking means for retaining said flexible cover releasably secured to the free end of said base to retain the strap in the pocket, said locking means integrally formed with said flexible cover and having a downwardly projecting arm terminating in an inwardly projecting catch designed to slightly overhang the free end of said base to retain said flexible cover in the closed position of the retainer;

e. releasing means for disengagement of said catch from the free end of said base so that said strap is positionable into or out of the pocket, said releasing means including fulcrum means laterally displaced from said free end of said base and vertically extending above said base by a distance such that a manually applied downwardly extending force against said cover between said fixed end and said fulcrum means causes a deflection of said cover therebetween and an angular outward displacement of said catch for disengagement with said free end of said base so that release thereof is obtained, and f. means for pivotably securing said fixed end of said base and said cover together, such that said cover may be opened into non-overlapping relation with said base to permit the strap to be placed in position on said base.

2. A shoulder strap retainer as defined in claim 1, and further including guide means for assisting the positioning of the finger on said cover in order to obtain the position thereon which best releases said catch.

3. A shoulder strap retainer as defined in claim 2, and further including decorative means secured to said cover, and including a finger depression contained thereon.

4. A shoulder strap retainer as defined in claim 1, wherein said catch is narrower than the width of the free end of said flexible cover.

5. A shoulder strap retainer as defined in claim 1, wherein said free end of said base has an inclined outwardly extending surface to facilitate the catch gripping said free end.

* * * * *